United States Patent [19]

Ruoff

[11] 4,160,628

[45] Jul. 10, 1979

[54] POSITIVE DISPLACEMENT MACHINE

[75] Inventor: Manfred Ruoff, Stuttgart, Fed. Rep. of Germany

[73] Assignee: Robert Bosch GmbH, Stuttgart, Fed. Rep. of Germany

[21] Appl. No.: 880,892

[22] Filed: Feb. 23, 1978

[30] Foreign Application Priority Data

Mar. 3, 1977 [DE] Fed. Rep. of Germany ..... 2709174

[51] Int. Cl.[2] ..... F04B 19/02; F04B 29/00

[52] U.S. Cl. ..... 417/465; 417/466

[58] Field of Search ..... 417/464, 465, 466; 418/54, 58

[56] References Cited

U.S. PATENT DOCUMENTS

| | | | |
|---|---|---|---|
| 3,591,318 | 7/1971 | Knapp | 417/465 |
| 3,656,875 | 4/1972 | Lock | 418/54 |

FOREIGN PATENT DOCUMENTS

| | | | |
|---|---|---|---|
| 862170 | 11/1940 | France | 417/466 |
| 624277 | 6/1949 | United Kingdom | 417/465 |

*Primary Examiner*—William L. Freeh

*Attorney, Agent, or Firm*—Michael J. Striker

[57] ABSTRACT

A positive displacement machine has a housing bounding an elongated interior compartment, a flat displaceable part-circular element in said compartment subdividing the latter into a pressure chamber and a suction chamber and having a recess in a periphery thereof bounded by two edges which are spaced circumferentially of the periphery, and drive elements for imparting to the displaceable element a translatory displacement and for superposing on the translatory displacement an angular movement such that during displacement of the element between two opposite dead center positions, the pressure and suction chambers are temporarily placed in communication by the recess of the displaceable element so as to permit displacement of a fluid from one to the other chamber. The displaceable element has a periphery exceeding over more than 180° of arc and a diameter corresponding to the width of the interior compartment of the housing in a direction transverse to the elongation of the compartment.

20 Claims, 11 Drawing Figures

POSITIVE DISPLACEMENT MACHINE

BACKGROUND OF THE INVENTION

The present invention relates to a positive displacement machine.

Positive displacement machines have been widely used in practice. Such positive displacement machines as piston pumps or rotary pumps are composed of a great number of separate parts, and for this reason they are very expensive and bulky. Relatively simple gear pumps which are used when it is necessary to provide a high pressure, are even more expensive inasmuch as voluminous sealing elements are provided on the side surfaces of the gears. They are not always satisfactory in operation, and the construction costs of high pressure gear pumps are great.

SUMMARY OF THE INVENTION

Accordingly, it is an object of the present invention to provide a positive displacement machine which avoids the disadvantages of the prior art.

More particularly, it is an object of the present invention to provide a positive displacement machine which has a simple construction and is very small, and at the same time is applicable for high pressure operations.

Another feature of the present invention is to provide a positive displacement machine which has an uncomplicated and weight-saving construction, and for this reason is especially applicable for the utilization in hydraulic systems of automobiles and airplanes.

In keeping with these objects, and with others which will become apparent hereinafter, one feature of the present invention resides, briefly stated, in a positive displacement machine having a flat displaceable part-circular received in a compartment of the housing and subdividing the same into a pressure chamber and a suction chamber, which displacement element has a recess formed in a periphery thereof and bounded by two edges which are spaced circumferentially of the periphery, and drive means for imparting to the element a translatory displacement and for superposing on the translatory displacement an angular movement such that during displacement of the element between two opposite dead center positions the pressure and suction chambers are temporarily placed in communication by the recess so as to permit displacement of a fluid from one to the other chamber.

The thus-constructed positive displacement machine has a simple construction and small dimensions, and at the same time is suitable for high pressure operations. It is especially suitable for utilization in hydraulic systems of automobiles and airplanes.

Another feature of the present invention is that the displaceable element may be composed of two or more separate displaceable members located in a common plane and jointly displaceable in the compartment of the housing by the drive means. When the displaceable element includes two such separate displaceable members, the latter during the translatory displacement move angularly in opposite directions relative to one another. In the case when the displaceable element is composed of several displaceable members, pressure equilibrium and a very small pulsation of flow of the working fluid is provided.

Still another feature of the present invention is that the displaceable element has a second recess forming an outlet passage and operative for temporarily placing the pressure chamber in communication with the pressure port during displacement of the displaceable element so as to permit displacement of the fluid from the pressure chamber. The first recess provided in the displaceable member may be substantially lenticular, whereas the second recess may be substantially triangular and may have a rounded base corner. The first mentioned recess may also be formed as a curved groove or an angle groove.

A further feature of the present invention is that the first and second recesses may be formed as surface recesses in a side wall of the displaceable element or through-going openings in the displaceable element. The recesses may be spaced from one another in a circumferential direction of the displaceable element preferably by an angular distance substantially equal to 130° of arc.

A still further feature of the present invention is that the elongated compartment of the housing may have two end portions which are rounded in accordance with a contour of the periphery of the displaceable element. On the other hand, the housing may have a straight wall bounding the elongated compartment in the region of the pressure chamber, and the displaceable element may have a flattened portion which faces toward the pressure chamber and is adapted to be located parallel to the straight wall of the compartment when the displaceable element is in its upper dead center position.

The novel features which are considered as characteristic for the invention are set forth in particular in the appended claims. The invention itself, however, both as to its construction and its method of operation, together with additional objects and advantages thereof will be best understood from the following description of specific embodiments when read in connection with the accompanying drawings.

DESCRIPTION OF PREFERRED EMBODIMENTS

Figure 1:
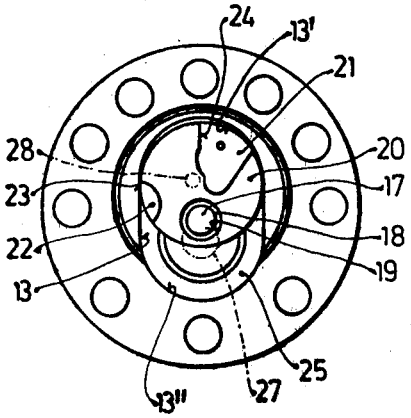
FIG. 1 is a plan view of a pump in accordance with the present invention.

A positive displacement machine in accordance with the invention is here shown as a pump. The pump has a housing 10 which is closed at its opposite sides by covers 11 and 12. The housing 10 has an elongated opening 13 whose longitudinal sides are connected with one another by arcuate sections 13' and 13''.

The cover 11 is connected with a part of motor means 14, for instance with a sliding ring bearing of a three-phase-current generator. A ball bearing 15 is mounted in the part 14 and supports a driving shaft 16. The driving shaft 16 has an eccentric pin 17 which is received in a bushing 18. The bushing 18 is arranged in a bore 19 of a disc-shaped piston 20 which forms a displaceable element of the pump. The bore 19 is provided close to an outer periphery of the piston 2, that is with a great eccentricity.

The diameter of the piston 20 substantially corresponds to the width of the opening 13 or, in other words, to the distance between the longitudinal sides of the opening 13. The piston 20 is located between the longitudinal sides of the opening 13 with a very small play. When the driving shaft 16 rotates in the clockwise direction, the piston 20, due to the eccentric location of the bore 19, is displaced in a translatory movement and a partially rotational movement, that is the piston 12 moves lengthwise the longitudinal opening 13 between the arcuate sections 13' and 13'' and at the same time is somewhat angularly displaced. The positions in which the piston 20 is located near the arcuate sections 13' and 13'' are an upper dead center position and a lower dead center position, respectively.

Two recesses 21 and 22 are formed in a side surface of the piston 2 facing toward the cover 12. The recess 22 is lenticular and substantially smaller than the recess 21. An upper boundary of the recess 22 with the periphery of the piston forms an edge 23. The recess 22 faces toward the left straight wall of the opening 13.

The recess 21 is circumferentially spaced from the recess 22 by an angular distance equal to substantially between 120° and 130° of arc. The recess 21 moves in the region adjacent to the right portion of the arcuate wall 13' of the opening 13. The recess 21 has a substantially triangular form with a rounded base corner and with an edge 24 at the left side facing toward the opening 22.

Figure 2:
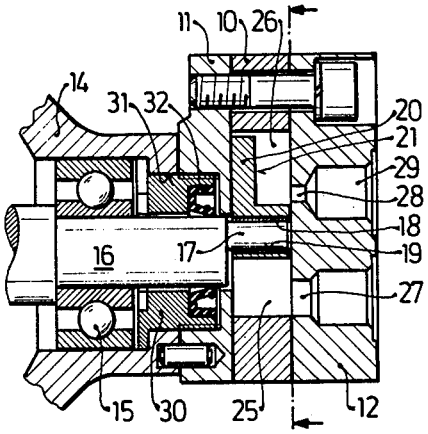
FIG. 2 is a view showing an axial section of the pump shown in FIG. 1.

The piston 20 subdivides the opening 13 into a suction chamber 25, which is located in a lower region in FIG. 1, that is adjacent to the arcuate section 13'', and a pressure chamber 26 located opposite to the suction chamber 25. A bore 27 is open into the suction chamber 25 and connected with a not shown conduit which is connected, in turn, with a source of a pressure medium. A bore 28 is opened into the pressure chamber 26 which is connected through a connecting bore 29 with a not shown conduit communicating with a consumer. As shown in FIG. 2, the recess 21 has a depth which is substantially equal to two thirds of the thickness of the piston 20. The same is true for the recess 22. The piston 20 has a periphery exceeding over somewhat more than 180° of arc. The cover 11 is centered relative to the part 14 of the motor means by an intermediate member 30 located in a bore 31. A sealing member 32 facing toward the pump, is arranged in the intermediate member 30.

Figure 3:
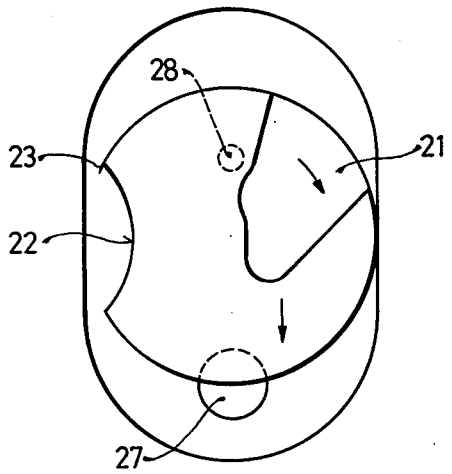
FIG. 3 is a schematic view showing a displaceable element of the pump in accordance with the present invention in a position in which a pressure chamber of the pump communicates with a suction chamber thereof.
Figure 4:
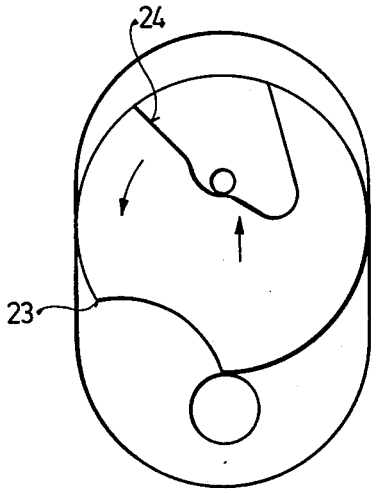
FIG. 4 is a schematic view showing a displaceable element of the pump in accordance with the present invention in a position in which the pressure chamber does not communicate with the suction chamber of the pump.

When the piston 20 moves from the upper dead center position downwardly and turns in the clockwise direction, as shown in FIG. 3, the recess 22 moves away of the left side of the opening 13 and thereby the suction chamber 25 communicates with the pressure chamber 26 so that the pressure medium flows from the former into the latter. When the piston 20 moves upwardly and turns in the counterclockwise direction as shown in FIG. 4, the edge 23 of the recess 22 interrupts the communication between the suction chamber 25 and the pressure chamber 26. The pressure medium located in the pressure chamber 26 is compressed inasmuch as this chamber is smaller, and therefore is displaced through the recess 21 into the bore 28. The communication from the pressure chamber 26 and the recess 21 to the bore 28 is performed by the edge 24 of the recess 21. When the edge 24 during the partial angular movement of the piston 20 is so located that the recess 21 communicates with the bore 28, the pressure medium is discharged to the consumer. Simultaneously, the pressure medium is sucked into the increased suction chamber 25.

Figure 11:
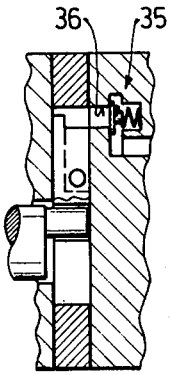
FIG. 11 is a view showing a partial cross-section of a pump in accordance with another embodiment of the present invention.

Controlling of the discharge can also be performed by a check valve 35 located in an outlet opening 36, as shown in FIG. 11. In dependence upon desirable dynamic behavior by smaller or greater partial opening through the recess 22, it is possible to select the closing or opening angle.

Figure 5:
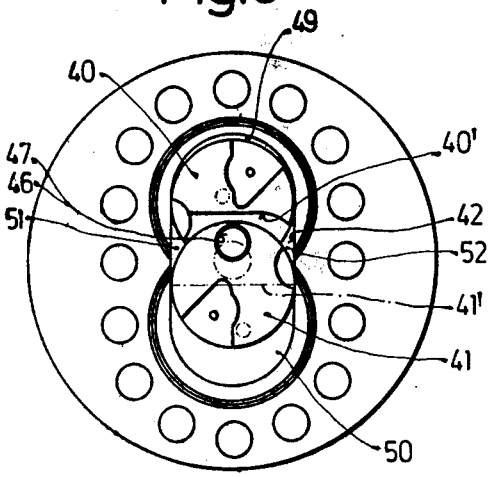
FIG. 5 is a plan view of a pump in accordance with another embodiment of the present invention.
Figure 6:
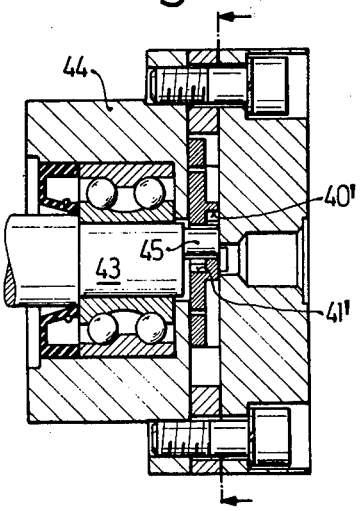
FIG. 6 is a view showing an axial section of the pump shown in FIG. 5.

In the pump shown in FIGS. 5 and 6 the displaceable element is composed of two pistons 40 and 41. The pistons 40 and 41 are located in a common plane and move in an opening 42 which is similar to the opening 13 but is somewhat longer than the latter. A driving shaft 43 is located directly in a housing cover 44. An eccentric pin 45 is received in bores 46 and 47 of the pistons 40 and 41, respectively, and surface recesses 40' and 41' are formed in the regions of the pistons wherein the latter contact one another. Thus, the pistons are located in the same plane. All other parts of the pump shown in FIGS. 5 and 6 are similar to those shown in FIGS. 1 and 2.

The operation of the pump shown in FIGS. 5 and 6 is easy to understand. However, the pistons 40 and 41 operates in opposite directions. An advantage of such operation is that the pump is fully balanced. This is because the pressure chambers 49 and 50 are located opposite to one another, whereas the suction chambers 51 and 52 are located in the central region of the longitudinal side of the opening 42.

FIGS. 7–10 show various displacement elements and the openings for receiving the displacement elements therein. In the embodiment shown in FIG. 5, the control passage from the suction chamber to the pressure chamber is formed in a different manner, that is this passage is curved and identified by reference numeral 55. Since the discharge control is performed by the check valve 35, the recess 21 similar to that shown in FIG. 1 is not needed. It is only necessary to provide a communication from the suction chamber to the pressure chamber. The same is true for the embodiments shown in FIGS. 6, 7 and 8.

Figure 8:
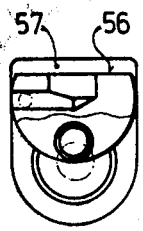
FIG. 8 is a view showing the displaceable element in accordance with a still further embodiment of the present invention.
Figure 9:
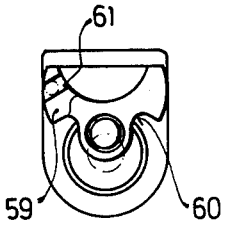
FIG. 9 is a view showing the displaceable element in accordance with an additional embodiment of the present invention.
Figure 10:
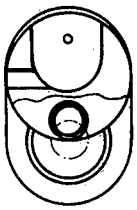
FIG. 10 is a view showing the displaceable element in accordance with still an additional embodiment of the present invention.

In the embodiment shown in FIG. 8 the piston is not formed as a full disc, but, instead, is a partially circular disc with a cut-off upper portion. It has a periphery exceeding 180° of arc so that in various angular positions of the piston the suction chamber is separated from the pressure chamber. Because of a flattened edge 56, the pressure chamber 57 is also flattened and in the upper dead center position is located parallel to the flat edge 56 of the piston. In the embodiment shown in FIG. 9, a piston 59 has reduced weight due to provision of openings 60, and a connecting passage 61 has a shape somewhat differing from the shape of the passage in accordance with the embodiment shown in FIG. 6.

Figure 7:
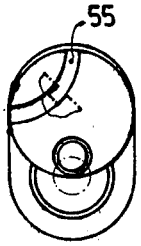
FIG. 7 is a view showing a displaceable element in accordance with a further embodiment of the present invention.

The piston in accordance with the embodiment shown in FIG. 10 is again round and has a connection at the suction side which is similar to that shown in FIG. 7. The operation of the pump in all the above cases are similar to that described with respect to FIGS. 1–4.

The pump in accordance with the embodiment shown in FIGS. 5 and 6 has an advantage that it provides for a uniform flow of the pressure medium. It is also possible to form the piston composed of four, six or eight piston members so as to increase the flow of the pressure medium. In these cases a crankshaft and corresponding ports on the disc shaped piston are necessary. It is also possible to form the recesses 21 and 22 in accordance with FIG. 1 not as surface openings, but, instead, as through-going openings.

Positive control which is performed by the pump in accordance with the present invention constitutes an essential simplification of the pump control. In this case it is possible to provide an advancement with greater number of revolutions. Various volumes can be simply obtained by varying of the width of the piston. The diameter of the pump is not increased in this case, but, instead, it becomes somewhat thicker. Simple parts can be used for manufacturing the pump, for instance, a section of a rod can be used as a piston. The displacement is fully independent on the number of revolutions, whereby the operation of the pump is comparatively quiet.

It will be understood that each of the elements described above, or two or more together, may also find a useful application in other types of constructions, differing from the types described above.

While the invention has been illustrated and described as embodied in a positive displacement machine, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A positive displacement machine, comprising a housing bounding an elongated interior compartment; a flat displaceable part-circular element received in said compartment and subdividing the same into a pressure chamber and a suction chamber having a pressure port and a suction port, respectively, said element having a periphery extending over more than 180° of arc and a diameter corresponding to the width of said interior compartment in a direction transverse to the elongation thereof, said displaceable element having in said periphery thereof a recess bounded by two edges which are spaced circumferentially of said periphery; and means for imparting to said element a translatory displacement and for superposing on said translatory displacement an angular movement such that during displacement of said element between two opposite dead center positions said pressure and suction chambers are temporarily placed in communication by said recess so as to permit displacement of a fluid from one to the other chamber.

2. The machine as defined in claim 1, wherein said recess forms an inlet passage temporarily communicating said pressure port with said pressure chamber.

3. The machine as defined in claim 1, wherein said displaceable element includes two separate displaceable members located in a common plane and jointly displaceable in said compartment by said means so that during the translatory displacement said displaceable members move angularly in opposite directions relative to one another.

4. The machine as defined in claim 1, wherein said recess is formed as a curved groove.

5. The machine as defined in claim 1, wherein said recess is formed as an angled groove.

6. The machine as defined in claim 1, wherein a check valve is arranged in said pressure port.

7. The machine as defined in claim 1, wherein said elongated compartment has two end sections spaced from one another in the direction of elongation thereof and bounded in accordance with a contour of said periphery of said displaceable element.

8. The machine as defined in claim 1, wherein said housing has a straight wall bounding said elongated compartment in the region of said pressure chamber, said displaceable member having a flattened portion which faces toward said pressure chamber and is adapted to be located parallel to said straight wall of said compartment when said displaceable element is in its upper dead center position.

9. The machine as defined in claim 1, wherein said recess is substantially lenticular.

10. The machine as defined in claim 1, wherein said means includes an eccentric member.

11. The machine as defined in claim 10, wherein said eccentric has an eccentric pin, said displaceable element being formed by a round disc having two flat side faces parallel to one another and provided with and eccentric bore in which said eccentric pin is received.

12. The machine as defined in claim 11, wherein said means further includes a rotatable shaft connected with and operative for rotation of said eccentric.

13. The machine as defined in claim 1, wherein said displaceable element has in said periphery thereof a second recess forming an outlet passage and operative for temporarily placing said pressure chamber in communication with said pressure port during displacement of said element so as to permit displacement of the fluid from said pressure chamber.

14. The machine as defined in claim 13, wherein said second recess is substantially triangular.

15. The machine as defined in claim 14, wherein said triangular second recess has a rounded base corner.

16. The machine as defined in claim 13, wherein said displaceable element has a side wall, said first-mentioned and second recesses being formed as surface recesses in said side wall of said displaceable element.

17. The machine as defined in claim 13, wherein said first-mentioned and second recesses are formed as through-going openings in said displaceable element.

18. The machine as defined in claim 13, wherein said displaceable element is formed as a round disc having two parallel side faces, said first-mentioned and second recesses being spaced from one another in a circumferential direction of said disc.

19. The machine as defined in claim 18, wherein said inlet passage and said outlet passage are spaced from one another by an angular distance substantially equal to 130° of arc.

20. The machine as defined in claim 18, wherein said first-mentioned and said second recesses are formed at one of said side faces of said displaceable element.

* * * * *